United States Patent [19]

Tillotson et al.

[11] 3,934,062

[45] *Jan. 20, 1976

[54] METHOD FOR COATING FABRICS FORMED INTO HAND GLOVES

[75] Inventors: Neil E. Tillotson, Dicksville Notch, N.H.; Sebastian A. Consoli, Lawrence, Mass.

[73] Assignee: Tillotson Corporation, Needham, Mass.

[ * ] Notice: The portion of the term of this patent subsequent to June 28, 1991, has been disclaimed.

[22] Filed: Dec. 6, 1972

[21] Appl. No.: 312,664

[52] U.S. Cl. ..... 427/185; 427/189; 427/195; 427/289; 427/299; 427/375; 2/167

[51] Int. Cl.[2] ..... B44D 1/094; A41D 19/00

[58] Field of Search ..... 117/21, 94; 2/167; 427/185, 189, 195, 289, 299, 375

[56] References Cited

UNITED STATES PATENTS

| | | | |
|---|---|---|---|
| 2,987,102 | 6/1961 | Heinrichs | 117/21 |
| 3,002,849 | 10/1961 | Harmon et al. | 117/21 |
| 3,028,251 | 4/1962 | Nagel | 427/185 |
| 3,050,738 | 8/1962 | Rytina | 2/167 |
| 3,152,002 | 10/1964 | Wisotzky et al. | 117/21 |
| 3,240,744 | 3/1966 | Kusiak | 427/185 |
| 3,264,371 | 8/1966 | Gruber et al. | 427/185 |
| 3,268,355 | 8/1966 | Brodeur | 2/167 |
| 3,277,042 | 10/1966 | Richart | 117/21 |
| 3,285,864 | 11/1966 | Abell et al. | 117/21 |
| 3,338,863 | 8/1967 | Haag | 117/21 |
| 3,471,428 | 10/1969 | Hodgson et al. | 117/21 |
| 3,585,062 | 6/1971 | Hand et al. | 117/21 |
| 3,761,965 | 10/1973 | Barasch | 2/167 |
| 3,778,291 | 11/1973 | Elliott et al. | 117/21 |
| 3,821,066 | 6/1974 | Tillotson et al. | 161/67 |

*Primary Examiner*—Charles L. Bowers, Jr.
*Attorney, Agent, or Firm*—Kenway & Jenney

[57] ABSTRACT

A fused resin coating is formed on a yarn fabric by impregnating the fabric with a liquid plasticizer for the resin and then coating the impregnated fabric with solid resin powder. The resin-coated fabric then is heated to fuse the resin. The coated fabrics obtained are more flexible and have better strength characteristics than fabrics coated with a resin plastisol composition.

3 Claims, 2 Drawing Figures

METHOD FOR COATING FABRICS FORMED INTO HAND GLOVES

BACKGROUND OF THE INVENTION

This invention relates to a method for coating fabrics with a thermoplastic resin, more particularly to a method for coating garments, with a thermoplastic resin and to the fabrics so formed.

Presently, garments such as shoes or gloves are coated with a thermoplastic resin composition by forming a base material such as knitted or woven yarn in the form of the garment, placing the garment on a form in the shape of the desired final article and dipping the garment on the form into a plastisol composition containing the resin so that the plastisol coats only the outside surface of the garment. Thereafter, the garment is removed from the plastisol composition and treated to cure the resin thereon. It has been proposed to increase the plasticizer concentration as a means for reducing the coating thickness. However, the resultant cured resin coating has reduced strength characteristics which has limited its use. Furthermore, this process has required using fabrics which have a relatively tight woven or knit configuration to prevent seepage of the plastisol through the fabrics and onto the inside surface of the garment.

SUMMARY OF THE INVENTION

The present invention is based upon the discovery that knit or woven yarns, such as in sheet form or in the form of a garment can be coated with a thermoplastic resin composition by impregnating the yarn or fabric with a plasticizer for the resin and subsequently depositing powdered resin onto the impregnated yarn. The resin powder contains no plasticizer or only low concentrations of plasticizer so that it is in the form of a freely flowing powder. Since the deposited resin is substantially free of plasticizer, it has an affinity for the plasticizer in the yarn thereby causing the plasticizer to be imbibed by the resin and concentrated on the surface of the yarn coated with the resin. The resin powder then is fused by heating.

DESCRIPTION OF PREFERRED EMBODIMENTS

The present invention comprises impregnating a yarn with a plasticizer for a resin which resin is to be subsequently coated on the yarn. Impregnation with plasticizer can be effected either prior to or subsequent to knitting or weaving the yarn into a sheet material or in the form of a garment. After the impregnation, the yarn is coated on one surface thereof with powdered unplasticized resin composition. The plasticizer is imbibed into the resin coating so that the surface of the fabric opposing the surface coated with resin is rendered substantially free of the plasticizer. Thereafter, the resin coating is fused as for example by being heated in air or in an oil or a salt bath.

The process of this invention provides substantial advantages over the processes of the prior art. The prime advantage is that the product obtained is far more flexible and lighter than coated garments obtained by dipping a knit or woven fabric into a plastisol composition. Furthermore, since the resin coating of this invention can contain less plasticizer than the garments of the prior art, the resultant coating has improved strength characteristics. In addition, lighter fabrics can be coated as compared with those coated by dipping in a plastisol.

Any method for coating resin onto the impregnated fabric by which a substantially uniform resin coating is attained can be employed. For example, the impregnated fabric can be placed into a gaseous dispersion of the resin. This is accomplished conveniently by placing the fabric into a fluidized bed of the powdered resin either during fluidization of the resin or just after the resin has been fluidized and prior to its becoming compacted by virtue of gravity. Another convenient coating method comprised placing the garment in a chamber and shaking the resin powder onto the garment. It is preferred to insert the fabric into a bed of powder just after it is fluidized since the coating can be effected quickly thereby. Since the resin powder contains little or no plasticizer therein, excess powder drops from the fabric upon removal from the fluidized bed. Alternatively, one surface of the impregnated fabric can be placed on the surface of a bed of resin or the resin can be spread on one surface of the fabric as for example with a doctor knife.

It has been found that it is essential to impregnate the base fabric with the plasticizer prior to contact with the resin. Various amounts of plasticizer can be mixed with the resin so long as the amount mixed is not great enough to cause the resin to become liquid or form a cake so that it cannot flow freely as a powder. The best wear of the coated fabric is obtained when no plasticizer is used in the resin, but a small amount of plasticizer in the resin will give some greater flexibility if this is desired.

Suitable resins that can be employed in the process of this invention are those that can be solvated by the plasticizer and adhered to the fabric including vinyl polymers such as polyvinylchloride, polyvinyl acetate, vinyl chloride-vinyl acetate copolymers, polyvinylidene chloride, or the like.

Any plasticizer which plasticizes the resin coating without damaging the fabric substrate can be employed. They can be employed alone or can be diluted with a suitable solvent for the plasticizer such as mineral oil which does not degrade the base fabric. Exemplary suitable plasticizers include adipic acid esters, such as diethyl adipate, di-n-hexyl adipate; glycol derivatives such as diethylene glycol dipelargonate, triethylene glycol dipelargonate; chlorinated paraffins; phosphoric acid derivatives such as tri-(2-ethyl-hexyl) phosphate, tributoxyethyl phosphate, triphenyl phosphate, cresyl diphenyl phosphate, tricresyl phosphate, and the like; phthalic acid derivatives such as dimethyl phthalate, dibutyl phthalate, dioctyl phthalate, buty cyclohexyl phthalate, or the like; sebacic acid derivatives such as dimethyl sebacate, dibutyl sebacate, diisooctyl sebacate, or the like.

Any suitable yarn can be employed to form the base fabric which is not plasticized by the plasticizer impregnated therein such as cotton, wool, nylon, acetate or the like.

The resin composition employed as a coating can comprise one hundred percent resin or it can contain the usual resin additive such as fillers, dyes, pigments, blowing agents, heat stabilizers, light stabilizers etc. As stated above, the resin also can contain a plasticizer but only in low concentration such that the resin composition remains in the form of a freely flowing powder.

The base fabric is impregnated with sufficient plasticizer so that the resin which contacts the fabric is plasticized and a large portion of the plasticizer is absorbed by the resin thereby rendering the surface of the fabric not coated with resin substantially free of plasticizer.

The resin need not be applied to the fabric in one step prior to fusing it on the fabric. A multistep procedure can be employed wherein a portion of the resin in applied to the fabric followed by heating the resin to partially fuse it. Thereafter, additional powdered resin can be applied and then it can be fused completely.

In one aspect of this invention, the fused resin coating can itself be coated with an aqueous emulsion of a polymer compatible with the resin coating to fill any pores in the fused resin coating and from a liquid impervious coating. The emulsion is applied to the resin coating and the resultant coated fabric is heated to remove water therefrom.

BRIEF DESCRIPTION OF THE DRAWINGS

This invention will be more fully described with reference to the accompanying drawings.

DETAILED SPECIFIC DESCRIPTION OF THE DRAWINGS

Figure 1:
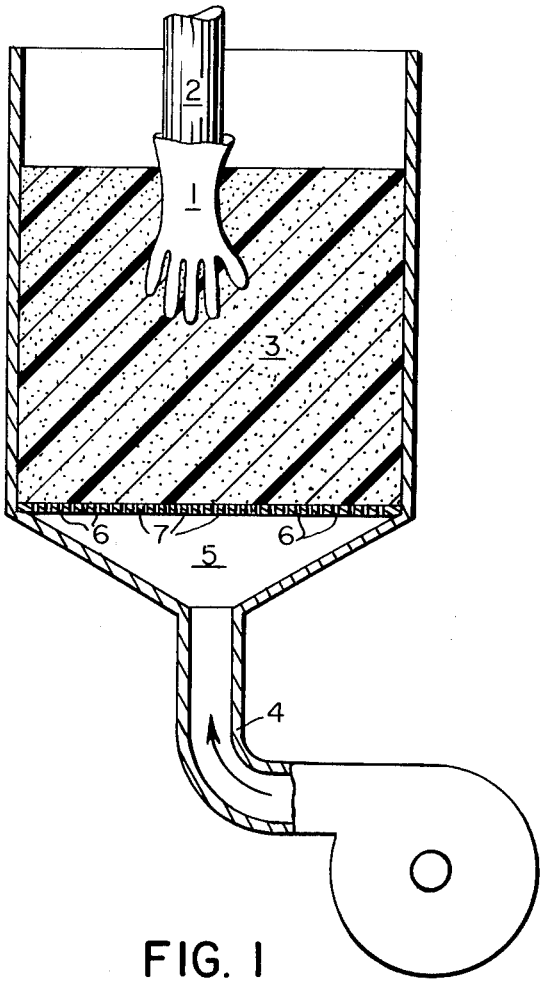
FIG. 1 is a cross-sectional view of an apparatus that can be employed in the process of this invention.
Figure 2:
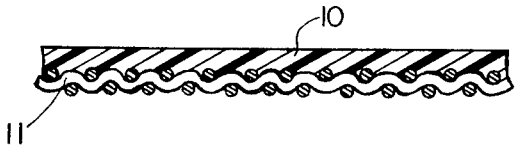
FIG. 2 is a cross-sectional view of the coated fabric.

Referring to the figures, a knitted yarn in the form of a glove 1 and impregnated with plasticizer is placed on a form 2 having the same configuration as the glove 1 and is coated with powdered resin by inserting the glove 1 into a bed of powdered resin 3. Prior to inserting the glove into the resin, the bed of powdered resin 3 is fluidized by passing a gas under pressure through conduit 4, plenum chamber 5 and openings 6 in plate 7 and into the bed of resin 3. The resin bed 3 is fluidized to disperse the powdered resin and thereby facilitate inserting the glove 1 into the bed of resin. When resin 3 is compacted, it is difficult to insert the glove 1 therein. Generally, the glove 1 can be inserted in the bed of resin within about 15 seconds after it is fluidized without encountering substantial forces cuased by compacting of the powdered resin. Since the yarn of the glove 1 is wet with plasticizer, the powdered resin will adhere to the outside surface thereof so that when it is removed from bed 3, the resin powder is retained on the surface. The glove coated with resin then is heated to fuse the resin and from a continuous coating 10 on the outside surface of the yarn 11 as shown in FIG. 2. If desired, the glove can be inserted in the resin bed 3 while it is being fluidized.

The following examples illustrate the present invention and are not intended to limit the same.

EXAMPLE I

A knitted glove was formed from cotton yarn impregnated with di-isooctyl phthalate plasticizer. The glove contained 40 grams of plasticizer and without plasticizer had a weight of 17 grams.

The glove was placed on an aluminum form, and then inserted into a fluidized bed of unplasticized poly (vinyl chloride) powder and removed immediately. Upon removal, the glove was coated with resin powder only on the outside surface. The glove then was inserted again into the powdered resin. Any excess powder accumulated between the fingers was gently blown from the glove. The form and glove were heated in an oven at 375°F for fifteen minutes with the fingers up to fuse the poly (vinyl chloride). The outside surface of the knitted glove comprised a slightly porous flexible poly (vinyl chloride) coating while the inside surface was free of resin and substantially free of plasticizer. The glove was easily strippable from the aluminum form. The surface of the glove can be rendered less porous by applying additional resin powder coatings in the manner described.

EXAMPLE II

A waterproof glove was made in accordance with the procedure of Example I by employing the following additional steps.

The coated glove was placed on an aluminum form and heated in an oven for 5 minutes at 300°F, removed therefrom and while hot dipped into a 40–50 percent vinyl acetate-ethylene copolymer aqueous emulsion (Airflex 400) to coat the outside surface of the glove. The glove was removed from the emulsion and heated in an oven for 10 minutes at 210°F and thereafter for 15 minutes at 385°F. The glove was removed from the oven, cooled to room temperature and stripped from the form.

We claim:

1. A process for coating a yarn fabric with a thermoplastic resin which comprises:

impregnating the yarn of the fabric with a liquid plasticizer;

coating the impregnated fabric with a free-flowing solid thermoplastic resin powder which contains little or no plasticizer and which is capable of being plasticized by said plasticizer, said resin powder being selected from at least one of polyvinyl chloride, polyvinyl acetate, vinyl chloride-vinyl acetate copolymers and polyvinylidene chloride;

heating the resin to fuse the resin to said fabric, said fabric being formed into a hand glove, including a plurality of fingers, to define an inside surface and an outside surface of said glove;

said fabric being contacted with said resin powder only on the outside surface of said glove;

said hand glove, in response to said impregnating, including a plurality of fingers impregnated with said plasticizer and wet therewith on said outside surface;

said free-flowing solid thermoplastic resin powder being provided by forming a fluidized mass of dispersed, solid thermoplastic resin powder; and said coating being effected by inserting said glove, while wet with said plasticizer, into said fluidized mass of solid thermoplastic resin powder with said fluidized mass providing dispersed, free-flowing solid resin powder beneath, between and laterally surrounding said fingers, maintaining said glove inserted into said fluidized mass while said dispersed free-flowing solid thermoplastic resin powder thereof adhers to said wet, plasticizer impregnated outside surface of said glove, withdrawing said glove out of said fluidized mass of dispersed, free-flowing solid thermoplastic resin powder with said solid resin powder adhering to said wet, plasticizer impregnated outside surface, and the fluidized nature of said mass of solid thermoplastic resin powder effecting dispersion of said solid thermoplastic resin powder and facilitating said insertion of said glove into said mass of solid thermoplastic resin powder.

2. The process of claim 1 which includes the additional step of coating the fused resin with a water emulsion containing a thermoplastic resin and heating the emulsion coating to evaporate the water and fuse the resin in said emulsion to the prior-fused resin.

3. The process of claim 1 wherein the resin comprises poly (vinyl chloride).

* * * * *